United States Patent [19]

Soma

[11] Patent Number: 4,713,025

[45] Date of Patent: Dec. 15, 1987

[54] ELECTRIC CONNECTOR FOR MULTI-CONDUCTOR FLAT CABLES

[75] Inventor: Keiji Soma, Tokyo, Japan

[73] Assignee: Hirose Electric Co., Ltd., Tokyo, Japan

[21] Appl. No.: 799,563

[22] Filed: Nov. 21, 1985

Related U.S. Application Data

[63] Continuation of Ser. No. 608,101, May 8, 1984, abandoned.

[30] Foreign Application Priority Data

Feb. 10, 1984 [JP] Japan ..... 59-23413

[51] Int. Cl.[4] ..... H01R 13/502

[52] U.S. Cl. ..... 439/752; 439/391; 439/449; 439/733; 439/873

[58] Field of Search ..... 339/97 R, 97 P, 98, 339/99 R, 17 F, 103 M, 176 M, 176 MF, 206 R, 217, 217 S

[56] References Cited

U.S. PATENT DOCUMENTS

| | | | |
|---|---|---|---|
| 4,068,912 | 1/1978 | Hudson, Jr. et al. | 339/99 R |
| 4,143,935 | 3/1979 | Goodman et al. | 339/99 R |
| 4,175,818 | 11/1979 | Kourimsky et al. | 339/208 |
| 4,410,222 | 10/1983 | Enomoto et al. | 339/99 R |
| 4,410,229 | 10/1983 | Stephenson | 339/97 P |
| 4,466,687 | 8/1984 | Frantz | 339/99 R |
| 4,533,200 | 8/1985 | Wilson | 339/99 R |

FOREIGN PATENT DOCUMENTS

| | | | |
|---|---|---|---|
| 0056184 | 7/1982 | European Pat. Off. | 339/99 R |
| 56-37667 | 9/1981 | Japan . | |
| 57-53629 | 11/1982 | Japan . | |

*Primary Examiner*—Gil Weidenfeld
*Assistant Examiner*—Thomas M. Kline
*Attorney, Agent, or Firm*—Fleit, Jacobson, Cohn & Price

[57] ABSTRACT

An electric connector for multi-conductor flat cables comprises an insulating housing having a substantially flat end face, at least two kinds of contacts, one kind at a level of height different from that of the contacts of another kind, and at least two cable connecting members in the form of a substantially flat plate. The contacts are arranged in at least two rows extending from the end face. The pitch of or space between the contacts arranged in one row is equal to that of the contacts arranged in another row and to the pitch of the conductors in a multi-conductor flat cable to be connected.

1 Claim, 12 Drawing Figures

ELECTRIC CONNECTOR FOR MULTI-CONDUCTOR FLAT CABLES

This application is a continuation of application Ser. No. 608,101 filed May 8, 1984 now abandoned.

BACKGROUND OF THE INVENTION

1. Field of the Invention

This invention relates to an electric connector for multi-conductor flat cables.

2. Description of the Prior Art

In recent electronic equipment, lightening, thinning, shortening and miniaturization have been promoted, and high-density packaging has become necessary therefor. Accordingly, a small-sized electric connector in which contactors are arrayed at the highest possible density has been required as an electric connector for use in the electronic equipment, and multi-conductor flat cables etc. in which a large number of cable conductors are arrayed at a high density have been required as cables to be used. In order to meet such requirements, a multi-conductor flat cable in which cable conductors are arrayed at pitches of 0.025 in. (0.635 mm) has hitherto been developed as opposed to a conventional multi-conductor flat cable in which cable conductors are arrayed at pitches of 0.05 in. (1.27 mm). As connectors for connecting such very small-sized and 0.025 in. (0.635 mm) pitch multi-conductor flat cables, there have been developed crimp contact connection type electric connectors for multi-conductor flat cables as disclosed in the official gazette of Japanese Patent Application Publication No. 56-37667, the official gazette of Japanese Patent Application Publication No. 57-53629, etc. With these known electric connectors of the crimp contact connection type, the pitches of the multi-conductor flat cable to be connected are rendered 0.025 in. (0.635 mm), which is ½ relative to the pitches of 0.05 in. (1.27 mm) in the multi-conductor flat cable having hitherto been used oftenest, and the arrayal pitches of contacts are also set at 0.025 in. (0.635 mm), which is ½ of those in the conventional cable, in conformity with the conductor arrayal pitches of the cable. Therefore, the size of the whole electric connector can be reduced to ½ of that of the hitherto commonest electric connector for equal numbers of cable conductors and equal numbers of contacts. The following disadvantages, however, have posed problems:

(1) Since the arrayal pitches are set at ½ of those in the conventional connector, the individual conductors of the flat cable become very fine, and the mechanical strength of the flat cable itself lowers. Moreover, since press-contact connections are made for such fine cable conductors, the cable conductors break down in the pressing contact connection operations, and inferior conduction, inferior insulation etc. are liable to occur.

(2) Unless both the flat cable and the electric connector are fabricated at very high precisions, the alignment between the cable conductors and the contacts is not favorable, and the cost becomes rather high.

(3) Since the contacts must be miniaturized and must be put into a complicated shape, they are very difficult of fabrication. This also forms a cause for the high cost.

An object of the present invention is to eliminate such problems of the prior arts, and to provide an inexpensive electric connector for multi-conductor flat cables in which contacts can be arrayed at a high density by the use of the hitherto conventional multi-conductor flat cables.

SUMMARY OF THE INVENTION

According to this invention, there is provided an electric connector for multi-conductor flat cables comprising an insulating housing having a substantially flat end face, at least two kinds of contacts, the contacts of one kind having a press-contact portion at a level of height different from that of the contacts of another kind, and at least two cable connecting members in the form of a substantially flat plate, the contacts being arranged in at least two rows in the insulating housing so that all of the contacts in the same row are of the same kind and in such a manner that the press-contact portions of the contacts protrude from the flat end face of the insulating housing, the pitch of the contacts arranged in one row being equal to that of the contacts arranged in another row and to the pitch of the conductors in a multi-conductor flat cable to be connected, the first cable connecting member having a cable receiving recess for receiving an end portion of the first multi-conductor flat cable to be connected, press-contact portion holes for receiving the press-contact portions of the contacts positioned in a lower level of height from the flat end face of the insulating housing, and press-contact portion passing holes for passing the press-contact portions of the contacts positioned in a higher level of height from the flat end face of the insulating housing, the first cable connecting member being able to be coupled to the flat end face of the insulating housing so as to effect press-contact connections between the first multi-conductor flat cable and the press-contact portions positioned in the lower level, the second cable connecting member having a cable receiving recess for receiving an end portion of the second multi-conductor flat cable to be connected, and press-contact portion holes for receiving the press-contact portions of the contacts positioned in a higher level of height from the flat end face of the insulating housing and protruding from the end face of the first cable connecting member coupled to the insulating housing, the second cable connecting member being able to be coupled to the first cable connecting member so as to be stacked on the end face of the first cable connecting member to effect press-contact connection between the second multi-conductor flat cable and the press-contact portions positioned in the higher level.

This invention will now be described in further detail with regard to preferred embodiments as illustrated in the accompanying drawings.

DESCRIPTION OF THE PREFERRED EMBODIMENTS

Figure 1:
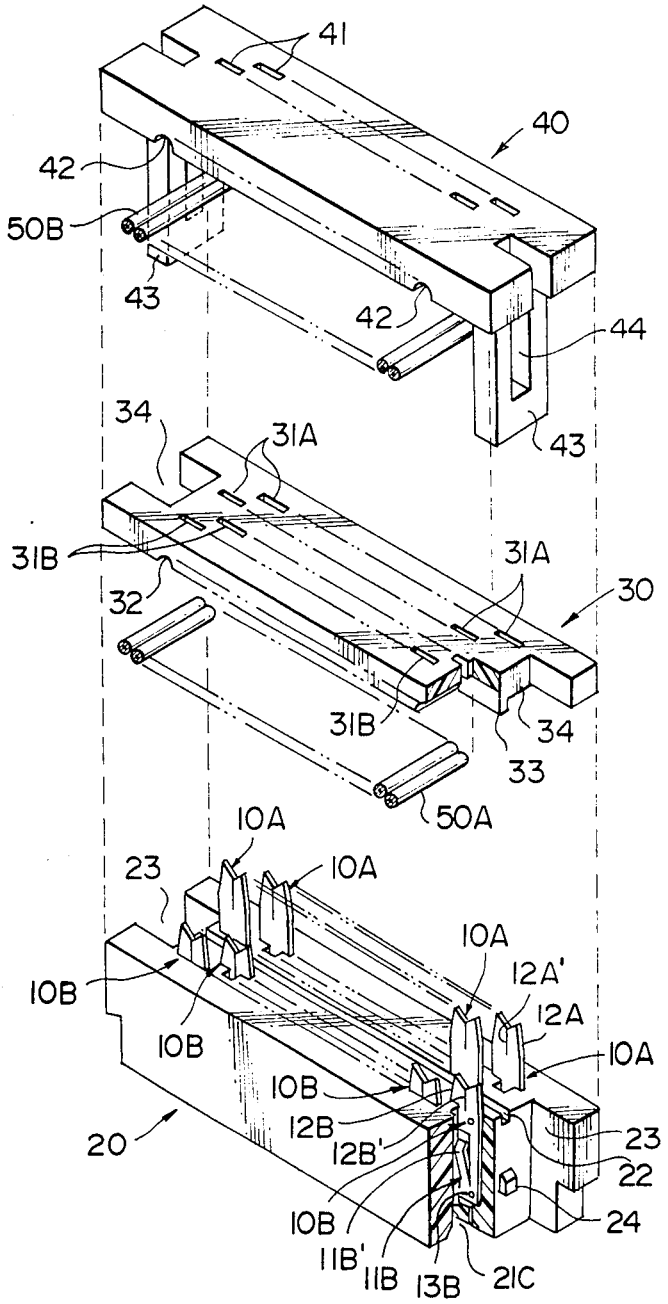
FIG. 1 is an exploded perspective view of an embodiment of the electric connector for multi-conductor flat cables according to this invention.

Referring now to FIG. 1, there is shown an embodiment of the electric connector for multi-conductor flat cables according to this invention. The electric connector of this embodiment comprises an insulating housing 20 in which contacts 10A having a press-contact portion at a high level and contacts 10B having a press-contact portion at a low level are arranged, a first cable connecting member 30 and a second cable connecting member 40.

Figure 2:
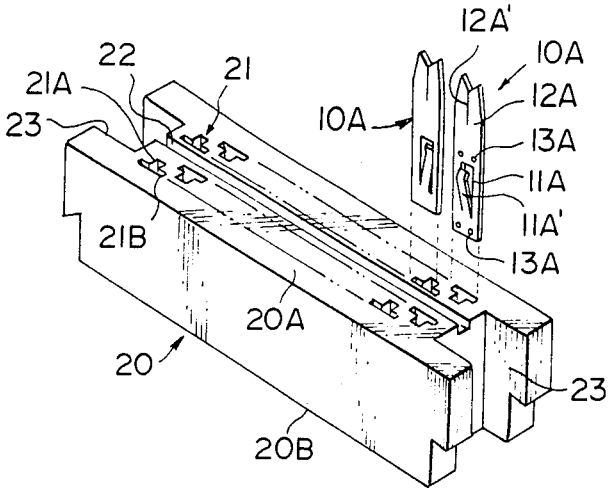
FIG. 2 is a perspective view of the insulating housing and contacts of the electric connector of FIG. 1.

FIG. 2 shows the insulating housing 20 and the contacts 10A in perspective. As clearly shown in FIG. 2, the contactor 10A of the press-contact type has a contact part 11A and the press-contact portion 12A. The contact part 11A is formed with a contact tongue 11A' for coming into contact with a mating contact, while the press-contact portion 12A is formed with a slit 12A' for bringing the cable conductor of a multi-conductor flat cable to be connected into press-contact connection. Further, the contact 10A is formed with bumps 13A in four places. As will be described later, these bumps 13A bite into the inner wall of the contact hole of the insulating housing 20, thereby functioning to dispose and fix the contact 10A to the insulating housing 20. As depicted in FIG. 1, the contact 10B of the press-contact type has a contact part llB and the press-contact portion 12B likewise to the contact 10A. The contact part 11B is formed with a contact tongue 11B' for coming into contact with a mating contact, while the press-contact portion 12B is formed with a slit 12B' for bringing the cable conductor of a multi-conductor flat cable to be connected into press contact connection. Further, the contact 10B is formed with bumps 13B similar to the bumps 13A in the contact 10A. It is to be noted, however, that the press-contact portion 12B of the contact 10B is formed so as to be lower in level than the press-contact portion 12A of the contact 10A.

The insulating housing 20 may be unitarily molded of an insulating material such as plastics material, and it has a substantially flat end face 20A as clearly shown in FIG. 2. In this insulating housing 20, a large number of contact holes 21 which penetrate the housing from the end face 20A to the opposite end face 20B are formed in tow rows.

Figure 3:
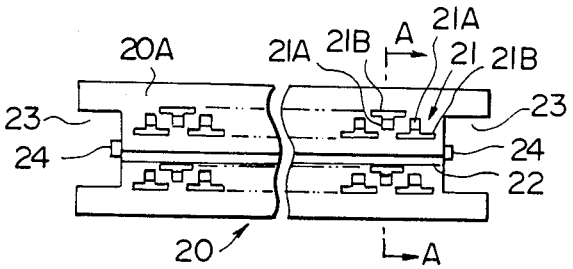
FIG. 3 is a top view of the insulating housing of the electric connector of FIG. 1.
Figure 3A:
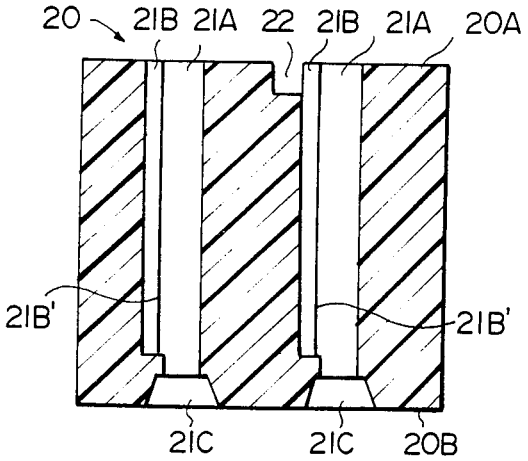
FIG. 3A is an enlarged sectional view as taken along line A—A in FIG. 3.

FIG. 3 is a top view of the insulating housing 20, and FIG. 3A is an enlarged sectional view taken along line A—A. As clearly shown in FIGS. 2, 3 and 3A, the contact holes 21 are T-shaped when viewed from the side of the end face 20A of the insulating housing 20. These contact holes 21 consist of contact tongue hole portions 21A which receive the contact tongues 11A' and 11B' of the respective contacts 10A and 10B, contact plate part hole portions 21B which receive plate parts coplanar with the press-contact portions 12A and 12B of the respective contacts 10A and 10B, and male contact receiving opening portions 21C which receive mating male contacts located below (not shown).

As clearly shown in FIG. 3, the pitches of or the spaces between the contact holes 21 in each row are equalized to those of the cable conductors of the multi-conductor flat cable to be connected, and they are set at 0.05 in. (1.27 mm) in this embodiment. In addition, the contact holes 21 are in opposite senses alternately, but the contact tongue hole portions 21A thereof have their centers aligned. As clearly shown in FIG. 1, accordingly, the contacts 10A are inserted and disposed in the contact holes 21 of one row in the alternately opposite senses in such a manner that the contact tongues 11A' are located in the contact tongue hole portions 21A of the contact holes 21, that the contacting plate parts are fitted in the contact plate part hole portions 21B, and that the press-contact portion 12A project from the end face 20A. Likewise, the contacts 10B are inserted and disposed in the contact holes 21 of the other row in the alternately opposite senses in such a manner that the contact tongues 11B' are located in the contact tongue hole portions 21A of the contact holes 21, that the contact plate parts are fitted in the contact plate part hole portions 21B, and that the press-contact portions 12B project from the end face 20A. On this occasion, the bumps 13A and 13B of the respective contacts 10A and 10B bite into the inner walls 21B' of the contact plate part hole portions 21B on both the sides thereof, so as to fix and hold the contacts 10A and 10B in the contact holes 21. The arrangement level of the press-contact portion 12A in one row protruding from the end face 20A differs from that of the press-contact portion 12B in the other row, and is higher than the latter.

Further, in that part of the insulating housing 20 which is substantially the middle between the two rows of contact holes 21, a slot 22 is formed which receives a ridge 33, to be described later, that is provided at the lower surface of the first cable connecting member 30. Moreover, guide grooves 23 for receiving and guiding the engaging legs 43 of the second cable connecting member 40 to be described later are formed in both the side surfaces of the insulating housing 20. In substantially the middle parts of the bottom walls of these guide grooves 23, there are formed retaining saliences 24 which serve to lock the coupled state of the insulating housing 20 and the second cable connecting member 40 in engagement with the engaging grooves 44 of the engaging legs 43 of the second cable connecting member 40.

As clearly shown in FIG. 1, the first cable connecting member 30 may be unitarily molded of an insulating material such as plastics in the shape of a substantially flat plate. It is formed with press-contact portion passing holes 31A which penetratingly pass the projecting press-contact portions 12A of the contact 10A disposed in the insulating housing 20, and press-contact portion holes 31B which receive the projecting press-contact portion 12B of the contacts 10B disposed in the insulating housing 20. Besides, cable receiving recesses 32 which receive the end part of a first multi-conductor flat cable 50A to be connected are formed in the lower surface parts of the press-contact portion holes 31B of the first cable connecting member 30, and the ridge 33 is formed between the press-contact portion holes 31B and the press-contact portion passing holes 31A. Further, guide grooves 34 which serve to receive and guide the engaging legs 43 of the second cable connecting member 40 to be described later are formed in both the side surfaces of the first cable connecting member 30.

As clearly shown in FIG. 1, the second cable connecting member 40 may be unitarily molded of an insulating material such as plastics in the shape of a substantially flat plate except the engaging legs 43. It is formed with press-contact portion holes 41 which receive the press-contact portion 12A of the contacts 10A projecting from the end face of the first cable connecting member 30 that is coupled to the insulating housing 20 as will be described later. Further, in the lower surface of the second cable connecting member 40, cable receiving recesses 42 which receive the end part of a second multi-conductor flat cable 50B to be connected are formed in correspondence with the positions of the press-contact portion holes 41. Moreover, both the side surfaces of the second cable connecting member 40 are unitarily formed with the engaging legs 43, which are formed with the engaging grooves 44.

An example of a procedure for connecting the first and second multi-conductor flat cables 50A and 50B to the electric connector of such construction will be described below:

(1) First, the contacts 10A and 10B are assembled into the insulating housing 20 as shown in FIG. 1.

(2) Subsequently, the first cable connecting member 30 is set on a pressing contact jig (not shown) with its top end face looking downwards and its cable receiving recesses 32 looking upwards. The end part of the first multi-conductor flat cable 50A is inserted and fastened in the cable receiving recesses 32 looking upwards.

Figure 4A:
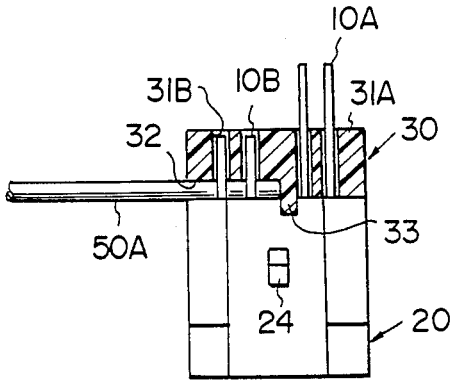
FIGS. 4A and 4B are partial sectional views for explaining the procedure of press-contact connection in the electric connector of FIG. 1.

(3) Next, the insulating housing 20 bearing the contacts 10A and 10B is set on the pressing contact jig with these contacts 10A and 10B looking downwards. The insulating housing 20 is pressed against the first cable connecting member 30 to which the first flat cable 50A has been insertedly fastened. Then, as shown in FIG. 4A, the press-contact portion 12B of the contacts 10B are connected in press contact to the corresponding cable conductors of the first flat cable 50A.

(4) At the next step, the second cable connecting member 40 is set with its top end face looking downwards and with its cable receiving recesses 42 looking upwards. The end part of the second flat cable 50B is inserted and fastened in the cable receiving recesses 42 looking upwards.

Figure 4B:
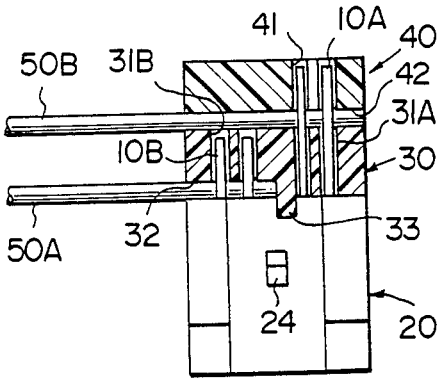

(5) Lastly, the insulating housing 20 to which the first flat cable 50A has been connected in press contact as stated before is set with the contacts 10A and 10B looking downwards, and it is pressed against the second cable connecting member 40. Then, as shown in FIG. 4B, the press-contact portions 12A of the contacts 10A are connected in press contact to the corresponding cable conductors of the second flat cable 50B, and the operations of the press-contact connections of the first and second flat cables 50A and 50B to this electric connector are completed.

The electric connector of the embodiment of the present invention constructed and connected as thus far described has the following effects:

(1) The cable core pitch of multi-conductor flat cables having heretofore been used oftenest, for example, 0.05 in. (1.27 mm) can be applied as it is, so that the flat cables of high reliability and low cost can be employed.

(2) Notwithstanding that the multi-conductor flat cables having heretofore been used oftenest (for example, those having the cable conductor pitch of 0.05 in. (1.27 mm) are used, the packaging density of the contacts can be doubled.

(3) The dimensions of the contacts need not be considerably reduced, and the shapes thereof may be very simple. Therefore, the maching is simple, the reliabilities of connections etc. are enhanced, and the cost can be lowered.

(4) The insulating housing and the first and second cable connecting members may also be simple in shape. Therefore, they are molded very easily and can be rendered less expensive.

Figure 5A:
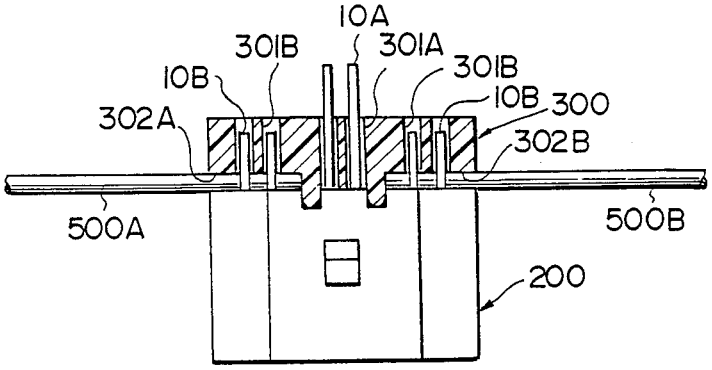
FIGS. 5A and 5B are views similar to FIGS. 4A and 4B, showing another embodiment of the electric connector according to this invention.
Figure 5B:
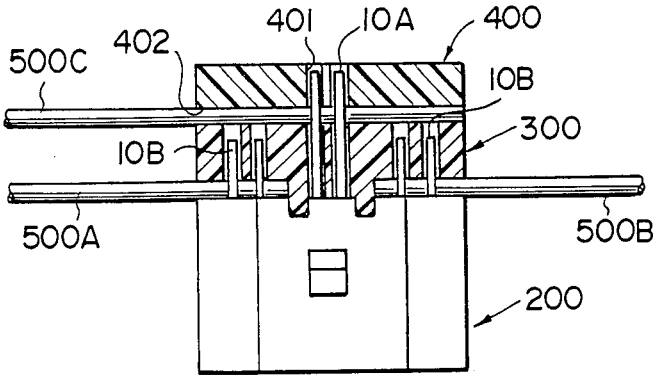

FIGS. 5A and 5B are views similar to FIGS. 4A and 4B, showing an electric connector which is another embodiment of the present invention. An insulating housing 200 in the electric connector of this embodiment is provided with three rows of contact holes. Shorter contacts 10B are assembled in the contact holes of the left row and the right row, and taller contacts 10A are assembled in the contact holes of the middle row. A first cable connecting member 300 is formed with press-contact portion passing holes 301A for passing the press-contact portions 12A of the contacts 10A assembled in the insulating housing 200, and press-contact portion holes 301B which receive the press-contact portions 12B of the contacts 10B. Cable receiving recesses 302A and 302B for receiving the end parts of a first flat cable 500A and a second flat cable 500B respectively are formed in the lower surface parts of the press-contact portion holes 301B. A second cable connecting member 400 is formed with press-contact portion holes 401 for receiving the press-contact portions 12A of the contacts 10A. A cable receiving recess 402 for receiving the end part of a third multi-conductor flat cable 500C is formed in the lower surface parts of the press-contact portion holes 401. An example of a procedure for connecting the first, second and third flat cables 500A, 500B and 500C to the electric connector of such embodiment will be described below:

(1) First, the contacts 10A and 10B are assembled into the insulating housing 200.

(2) Subsequently, the first cable connecting member 300 is set on a pressing contact jig with its top end face looking downwards. The end part of the first flat cable 500A and that of the second flat cable 500B are respectively inserted and fastened in the cable receiving recesses 302A and 302B looking upwards.

(3) Next, the insulating housing 200 is set on the pressing contact jig with the contactors 10A and 10B looking downwards. The insulating housing 200 is pressed against the first cable connecting member 300 to which the end parts of the first and second flat cables 500A and 500B have been insertedly fastened. Then, as shown in FIG. 5A, the press-contact portions 12B of the contacts 10B are connected in press contact to the corresponding cable cores of the first and second flat cables 500A and 500B.

(4) At the next step, the second cable connecting member 400 is set with its top end face looking downwards and its cable receiving recesses 402 looking upwards. The end part of the third flat cable 500C is inserted and fastened in the cable receiving recesses 402 looking upwards.

(5) Lastly, the insulating housing 200 to which the first and second flat cables 500A and 500B have been connected in press-contact as stated before are set with the contacts 10A and 10B looking downwards, and it is pressed against the second cable connecting member 400. Then, as shown in (B) of FIG. 5, the pressure connection parts 12A of the contacts 10A are connected in press-contact to the corresponding cable cores of the third flat cable 500C, and the operations of the press-contact connections of the first, second and third flat cables 500A, 500B and 500C to this electric connector are completed.

The electric connector of this embodiment in FIG. 5 has the effect that the packaging density of the contacts can be tripled, in addition to the effects attained by the electric connector as stated before in conjunction with FIGS. 1 to 4A and 4B.

Figure 6A:
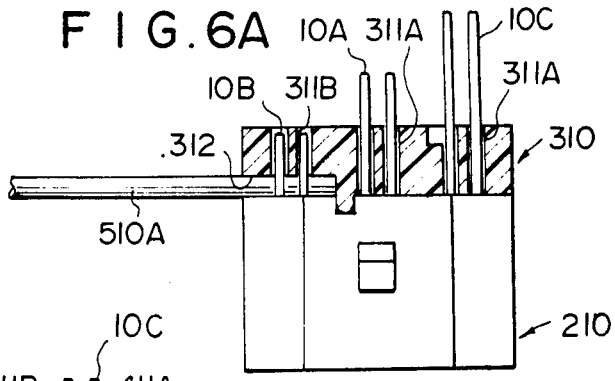
FIGS. 6A, 6B and 6C are views similar to FIGS. 4A and 4B, showing still another embodiment of the electric connector according to this invention.
Figure 6B:
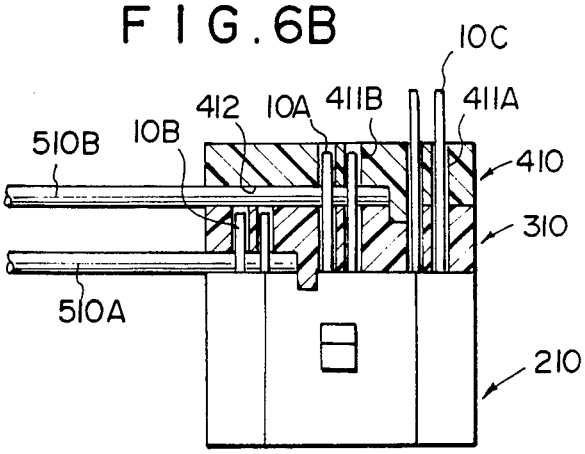
Figure 6C:
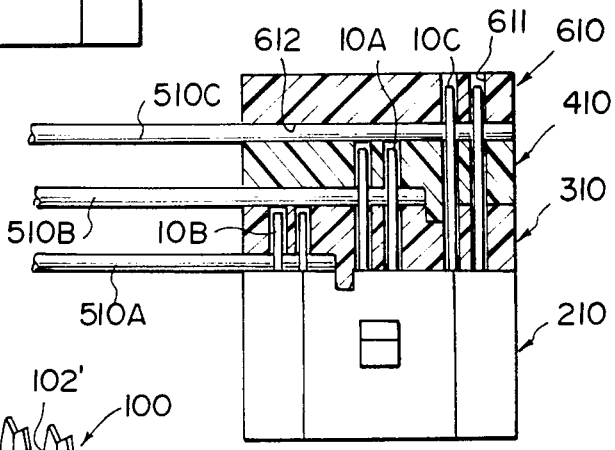

FIGS. 6A, 6B and 6C are views similar to FIGS. 4A and 4B, showing an electric connector which is still another embodiment of the present invention. An insulating housing 210 in the electric connector of this embodiment is provided with three rows of contact holes. The shortest contacts 10B are assembled in the contact holes of the left row, medium-height contacts 10A are assembled in the contact holes of the middle row, and the tallest contacts 10C are assembled in the contact holes of the right row. Since press-contact connections in three stages are performed, cable connecting members consist of first, second and third cable connecting members 310, 410 and 610.

The first cable connecting member 310 is formed with press-contact portion passing holes 311A which pass the press-contact portions of the contacts 10A and 10C, and press-contact portion holes 311B which receive the press-contact portions of the contacts 10B. The lower surfaces of the press-contact portion holes 311B are formed with a cable receiving recess 312 for receiving the end part of a first multi-conductor flat cable 510A. The second cable connecting member 410 is formed with press-contact portion passing holes 411A which pass the press-contact portions of the contacts 10C, and press-contact portion holes 411B which receive the press-contact portions of the contacts 10A. The lower surfaces of the press-contact portion holes 411B are formed with a cable receiving recess 412 for receiving the end part of a second multi-conductor flat cable 510B. The third cable connecting member 610 is formed with press-contact portion holes 611 which receive the press-contact portions of the contacts 10C, and the lower surfaces of which are formed with a cable receiving recess 612 for receiving the end part of a third multi-conductor flat cable 510C. Since a procedure for connecting the first, second and third flat cables 510A, 510B and 510C to the electric connector of such embodiment conforms to the procedure explained as to the preceding embodiment, it shall not be repeatedly detailed here. First, as shown in FIG. 6A, the first flat cable 510A is connected in press-contact to the contacts 10B by the use of the first cable connecting member 310; subsequently, as shown in FIG. 6B, the second flat cable 510B is connected in press-contact to the contacts 10A by the use of the second cable connecting member 410; and lastly, as shown in FIG. 6C, the third flat cable 510C may be connected in press-contact to the contacts 10C by the use of the third cable connecting member 610.

Figure 7:
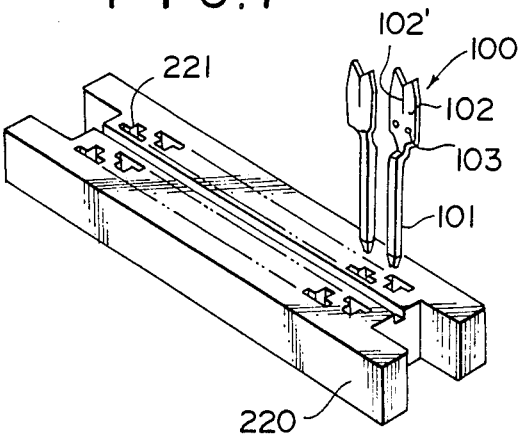
FIG. 7 is an exploded perspective view of parts of still another embodiment of the electric connector according to this invention.

While the contacts of the electric connectors of the embodiments explained. above have been female contacts, the present invention is not restricted to the female type but is similarly applicable to a connector in which male contacts are disposed. Such an example is schematically shown in FIG. 7. In this embodiment, a male contact 100 is made up of a contact part 101 and a press-contact portion 102. The press-contact portion 102 is provided with a slit 102′ for connecting the conductor of a cable in press-contact, and is further provided with bumps 103 for fastening the contact to the contact hole 221 of an insulating housing 220. Two sorts of tall and short male contacts of such construction are prepared, and the short male contacts are disposed in the left row of contact holes 221 of the insulating housing 220, while the tall male contacts are disposed in the right row of contact holes 221.

I claim:

1. An electric connector for at least first and second multi-conductor flat cables having conductors therein being spaced apart a predetermined distance, said electric connector comprising:

an insulating housing having a substantially flat end face;

a plurality of first and a plurality of second contacts extending from said end face, said first contacts having a press-contact portion located at a level of height with respect to said end face different from the level of height of said second contacts, each contact having said press-contact portion and a contact part for securing said contacts in said housing;

first and second cable connecting members in the form of a substantially flat plate;

said first contacts and said second contacts extending from said end face in at least two respective rows so that all of the contacts in the same row are arranged in a uniformly staggered fashion across said end face with the contact parts of said contacts within said rows being aligned along a line and the press-contact portions of the contacts in the same row being aligned along two lines with said contact parts being located between said two lines, a spacing between adjacent staggered press-contact portions of the contacts arranged in one row being equal to a spacing between adjacent staggered press-contact portions of the contacts arranged in another row and being equal to said predetermined distance spacing between the conductors in said multi-conductor flat cable to be connected;

said first cable connecting member having a cable receiving recess for receiving an end portion of the first multi-conductor flat cable to be connected, press-contact portion holes for receiving the press-contact portions of the first contacts, and press-contact portion passing holes for passing the press-contact portions of the second contacts, the first cable connecting member being able to be coupled to said end face of said insulating housing;

said second cable connecting member having a cable receiving recess for receiving an end portion of the second multi-conductor flat cable to be connected, and press-contact portion holes for receiving the press-contact portions of the second contacts protruding from the substantially flat plate face of the first cable connecting member coupled to said insulating housing, the second cable connecting member being able to be coupled to the first cable connecting member for stacking on said substantially flat plate face of the first cable connecting member.

* * * * *